US008181404B2

(12) United States Patent
Klein

(10) Patent No.: US 8,181,404 B2
(45) Date of Patent: May 22, 2012

(54) HEAD-OF-WALL FIREBLOCKS AND RELATED WALL ASSEMBLIES

(76) Inventor: James Alan Klein, Bellevue, WA (US)

( * ) Notice: Subject to any disclaimer, the term of this patent is extended or adjusted under 35 U.S.C. 154(b) by 1011 days.

(21) Appl. No.: 11/206,500

(22) Filed: Aug. 18, 2005

(65) Prior Publication Data

US 2006/0137293 A1 Jun. 29, 2006

Related U.S. Application Data

(60) Provisional application No. 60/637,379, filed on Dec. 20, 2004.

(51) Int. Cl.
*E04B 1/94* (2006.01)
*E04B 1/88* (2006.01)

(52) U.S. Cl. ..... 52/232; 52/241; 52/317; 52/262

(58) Field of Classification Search ..... 52/241, 52/242, 232, 1, 317, 262, 396.01, 335, 334, 52/265, 236.9, 483.1, 481.1, 831
See application file for complete search history.

(56) References Cited

U.S. PATENT DOCUMENTS

| | | | | | |
|---|---|---|---|---|---|
| 3,786,604 | A | * | 1/1974 | Kramer | 52/232 |
| 3,908,328 | A | * | 9/1975 | Nelsson | 52/769 |
| 3,974,607 | A | * | 8/1976 | Balinski | 52/232 |
| 4,178,728 | A | * | 12/1979 | Ortmanns et al. | 52/232 |
| 4,203,264 | A | * | 5/1980 | Kiefer et al. | 52/1 |
| 4,424,653 | A | * | 1/1984 | Heinen | 52/204.55 |
| 4,850,385 | A | * | 7/1989 | Harbeke | 137/75 |
| 4,918,761 | A | * | 4/1990 | Harbeke | 4/252.4 |
| 4,930,276 | A | * | 6/1990 | Bawa et al. | 52/211 |
| 5,127,760 | A | * | 7/1992 | Brady | 403/230 |
| 5,155,957 | A | * | 10/1992 | Robertson et al. | 52/232 |
| 5,244,709 | A | * | 9/1993 | Vanderstukken | 428/99 |
| 5,347,780 | A | * | 9/1994 | Richards et al. | 52/204.1 |
| 5,367,850 | A | * | 11/1994 | Nicholas | 52/516 |
| 5,390,465 | A | * | 2/1995 | Rajecki | 52/741.3 |
| 5,452,551 | A | * | 9/1995 | Charland et al. | 52/232 |
| 5,755,066 | A | * | 5/1998 | Becker | 52/241 |
| 5,913,788 | A | * | 6/1999 | Herren | 52/241 |
| 5,921,041 | A | * | 7/1999 | Egri, II | 52/241 |
| 6,058,668 | A | * | 5/2000 | Herren | 52/241 |
| 6,176,053 | B1 | * | 1/2001 | St. Germain | 52/232 |
| 6,216,404 | B1 | * | 4/2001 | Vellrath | 52/232 |
| 6,305,133 | B1 | * | 10/2001 | Cornwall | 52/232 |
| 6,405,502 | B1 | * | 6/2002 | Cornwall | 52/220.8 |
| 6,679,015 | B1 | * | 1/2004 | Cornwall | 52/232 |
| 7,043,880 | B2 | * | 5/2006 | Morgan et al. | 52/2.23 |

FOREIGN PATENT DOCUMENTS

| | | | | |
|---|---|---|---|---|
| JP | 06146433 | A | * | 5/1994 |
| JP | 06220934 | A | * | 8/1994 |

* cited by examiner

*Primary Examiner* — Phi Dieu Tran A

(74) *Attorney, Agent, or Firm* — Thomas E. Loop; Graybeal Jackson LLP

(57) ABSTRACT

Fireblock devices, wall assemblies and related methods useful for retarding the spread of smoke and fire through dynamic head-of-wall construction joints and gaps are disclosed herein. In one embodiment, the fireblock device is characterized by an elongated angled channel member having an elongated intumescent material strip, wherein the angled channel member is defined by an elongated top flange member connected to an elongated side flange member along a lengthwise edge, and wherein the top and side flange members define a right angle and a lengthwise interior corner region, and wherein the top and side flange members each have inner flange member surfaces that face inwardly with respect to the interior corner region, and outer flange member surfaces that face outwardly with respect to the interior corner region, and wherein the intumescent material strip is affixed on the outer flange member surface of the side flange member.

3 Claims, 7 Drawing Sheets

HEAD-OF-WALL FIREBLOCKS AND RELATED WALL ASSEMBLIES

CROSS-REFERENCE TO RELATED APPLICATION

This application claims the benefit of U.S. Provisional Application No. 60/637,379 filed on Dec. 20, 2004, which application is incorporated herein by reference in its entirety for all purposes.

TECHNICAL FIELD

The present invention relates generally to fire blocking and containment systems used in the construction of buildings and, more particularly, to fireblocks used to seal head-of-wall construction joints and gaps.

BACKGROUND OF THE INVENTION

As is appreciated by those skilled in the art of building construction, a head-of-wall joint (also sometimes referred to as a top-of-wall joint) refers to the junction or interface existing between a building wall and the ceiling (where the ceiling may also be a floor or corrugated pan roof deck, for example). Head-of-wall joints often present a serious challenge in terms of reducing or preventing the spread of smoke and fire during a building fire. In this regard and in common practice, a wall to ceiling connection of many newly constructed buildings consists essentially of an inverted U-shaped (or M-shaped) elongated steel channel (or track) configured to receive steel studs between the legs of the shaped channel. A wallboard is generally attached to at least one side of the studs. The studs and wallboard are in many instances spaced apart from the ceiling a short gap distance in order to allow for ceiling deflections caused by seismic activity or moving overhead loads. Channel and stud assemblies that allow for ceiling deflections are commonly referred to as dynamic head-of-wall systems. Exemplary steel stud wall constructions may be found in U.S. Pat. Nos. 4,854,096 and 4,805,364 both to Smolik, and U.S. Pat. No. 5,127,203 to Paquette. Exemplary dynamic head-of-wall systems having steel stud wall constructions may be found in U.S. Pat. No. 5,127,760 to Brady, and U.S. Pat. No. 6,748,705 to Orszulak et al.

In order to contain the spread of smoke and fire, a fire resistant material such as, for example, mineral wool is often times stuffed into the gaps between the ceiling and wallboard. For example, mineral wool is often stuffed between a steel header beam (e.g., an elongated U-shaped channel) and a corrugated or fluted steel roof deck (used in many types of steel and concrete building constructions); a fire resistant and generally elastomeric spray coating is then applied onto the exposed mineral wool to thereby form a fire resistant joint seal. In certain situations where the ceiling to wallboard gap is relatively small, a fire resistant and elastomeric caulk is commonly applied so as to fill any small gaps. In still another approach and as disclosed in U.S. Pat. Nos. 5,471,805 and 5,755,066 both to Becker, a slidable noncombustible secondary wall member is fastened to an especially configured steel header beam and immediately adjacent to the wallboard. In this configuration, the secondary wall member provides a fire barrier that is able to accommodate ceiling deflections. All of these approaches, however, are relatively labor intensive and thus expensive.

Intumescent materials have been used to seal certain types of construction gaps such as, for example, conduit through-holes. In this regard, intumescent and fire barrier materials (often referred to as firestop materials or fire retardant materials) have been used to reduce or eliminate the passage of smoke and fire through openings between walls and floors and the openings caused by through-penetrations (i.e., an opening in a floor or wall which passes all the way through from one room to another) in buildings, such as the voids left by burning or melting cable insulation resulting from a fire in a modern office building. Characteristics of fire barrier materials suitable for typical commercial fire protection use include flexibility prior to exposure to heat, the ability to insulate and/or expand, and the ability to harden in place upon exposure to fire (i.e., to char sufficiently to deter the passage of heat, smoke, flames, and/or gases). Although many such materials are available, the industry has long sought better and more effective uses of these materials and novel approaches for better fire protection, especially in the context of head-of-wall construction joints and gaps.

Thus, and although construction joints and gaps are generally sealed in some manner (e.g., mineral wool and/or elastomeric coatings), there are few products and methods available for effectively and efficiently sealing head-of-wall construction joints and gaps (to thereby significantly enhance the ability of such joints and gaps to withstand smoke and fire penetration). In particular, there are very few products and methods available that address the needs for adequate fire protection sealing of dynamic head-of-wall systems associated with steel stud wall constructions. Thus, there is still a need in the art for new and improved fireblocks and fire retarding devices, including related wall assemblies, systems and methods. The present invention fulfills these needs and provides for further related advantages.

BRIEF DESCRIPTION OF THE DRAWINGS

The drawings are intended to be illustrative and symbolic representations of certain exemplary embodiments of the present invention and as such they are not necessarily drawn to scale. In addition, it is to be expressly understood that the relative dimensions and distances depicted in the drawings (and described in the "Detailed Description of the Invention" section) are exemplary and may be varied in numerous ways. Finally, like reference numerals have been used to designate like features throughout the several views of the drawings.

SUMMARY OF THE INVENTION

Figure 1:
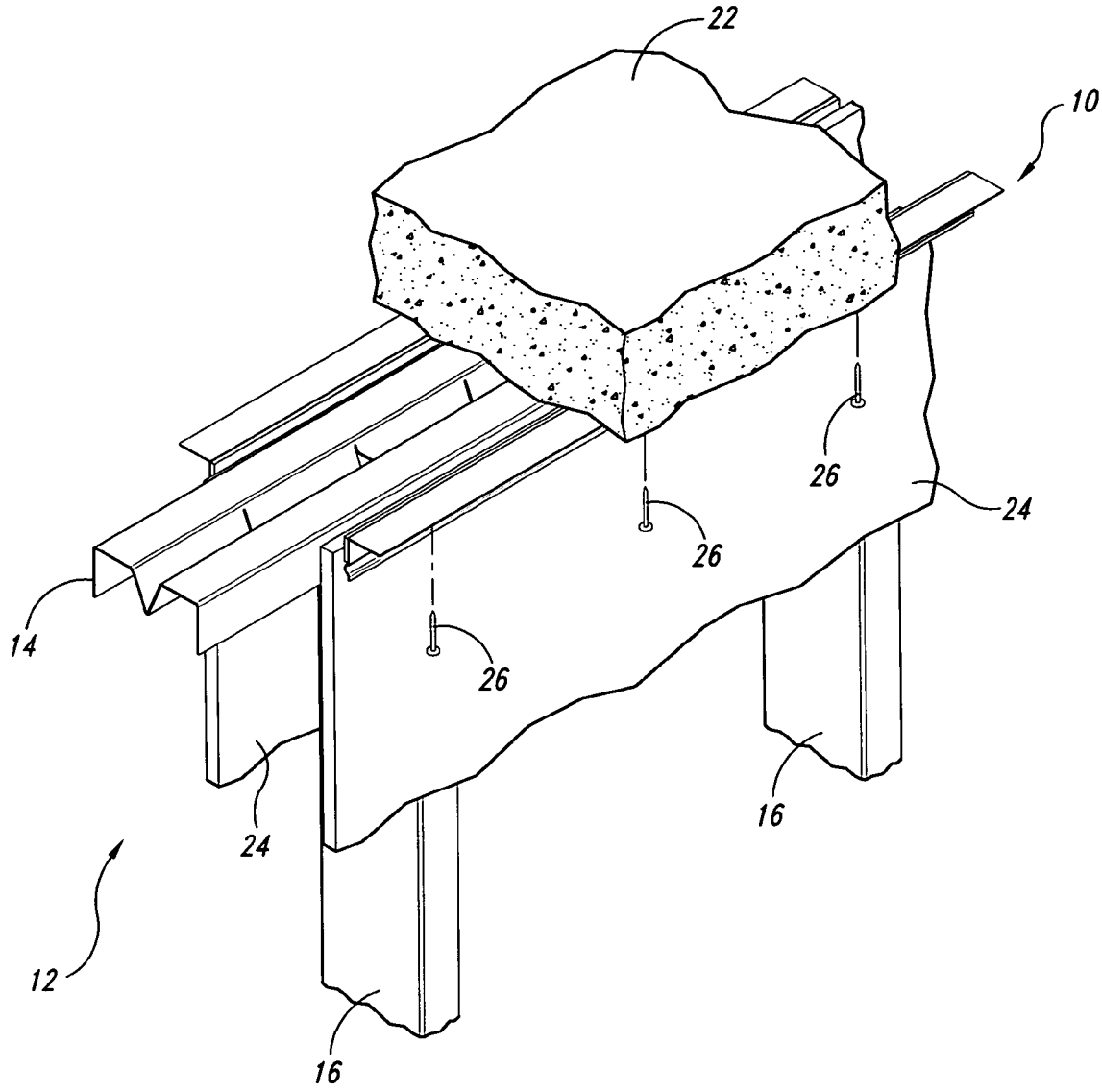
FIG. 1 illustrates a top side perspective view of a portion of a head-of-wall construction joint having an adjacent fireblock device in accordance with an embodiment of the present invention, wherein the device is shown in combination with a wall assembly fastened to a concrete roof deck, and wherein the wall assembly comprises a plurality of steel studs (having wallboard affixed thereon) engaged into a M-shaped steel header channel.

In one embodiment, the present invention is directed to a fireblock device especially configured and useful for smoke and fire sealing a dynamic head-of-wall construction joint or gap. In this embodiment, the head-of-wall fireblock device comprises an elongated angled channel member having an outwardly facing elongated intumescent material strip. Preferably, the angled channel member is defined by an elongated top flange member connected to an elongated side flange member along a lengthwise edge, wherein the top and side flange members define a right angle and, relative to the top and side flange members, a lengthwise interior corner region. The top and side flange members each have inner flange member surfaces that face inwardly with respect to the interior corner region, and outer flange member surfaces that face outwardly with respect to the interior corner region; and the intumescent material strip is positioned on the outer flange member surface of the side flange member (or inner flange member surface in an alternative embodiment).

In another embodiment, the present invention is directed to a head-of-wall fireblock device in combination with a dynamic head-of-wall assembly. In this embodiment, the combination comprises (1) an elongated sheet-metal header attached to a ceiling; (2) a plurality of sheet-metal studs having upper and lower ends, the studs being vertically positioned relative to the ceiling and such that the upper ends are engaged within the header and proximate to a bottom interior surface of the header, each of the upper ends of the plurality of studs being spaced apart from the bottom interior surface of the header a first gap distance that allows for ceiling deflections; (3) wallboard attached to at least one side of the plurality of studs, the wallboard being positioned apart from the ceiling a second gap distance that is about equal to the first gap distance; (4) an elongated angled channel member attached to the ceiling, the header, or the ceiling and the header, the angled channel member being defined by an elongated top flange member connected to an elongated side flange member along a lengthwise edge, the top and side flange members defining a right angle and a lengthwise interior corner region, the top and side flange members each have inner flange member surfaces that face inwardly with respect to the interior corner region, and outer flange member surfaces that face outwardly with respect to the interior corner region; and (5) an intumescent material strip affixed on the outer flange member surface of the side flange member and positioned immediately adjacent to the second gap.

The present invention is also directed to methods for fire sealing head-of-wall construction joints and gaps with one of the inventive devices fireblocking disclosed herein. The inventive methods comprise the steps of at least (1) providing a fireblock device as disclosed herein, (2) providing a room with a ceiling and a construction wall assembly that defines a head-of-wall construction joint or gap, and (3) attaching said fireblock adjacent to the ceiling and wall assembly such that an intumescent material strip is positioned immediately adjacent to the head-of-wall construction joint or gap.

These and other aspects of the present invention will become more evident upon reference to the following detailed description and attached drawings. It is to be understood, however, that various changes, alterations, and substitutions may be made to the specific embodiments disclosed herein without departing from their essential spirit and scope. In addition, it is to be further understood that the drawings are intended to be illustrative and symbolic representations of certain exemplary embodiments of the present invention and as such they are not necessarily drawn to scale. Finally, it is expressly provided that all of the various references cited herein are incorporated herein by reference in their entireties for all purposes.

DETAILED DESCRIPTION OF THE INVENTION

Referring now to the drawings wherein like reference numerals designate identical or corresponding elements, and more particularly to FIGS. 1-5, the present invention in one preferred embodiment is directed to a fireblock device designated by the numeral 10. For purposes of illustration, the fireblock device 10 is shown in FIGS. 1-3, and 5 in combination with a dynamic head-of-wall assembly 12 that consists essentially of an elongated sheet-metal channel shaped footer (not shown), an elongated sheet-metal M-shaped header 14 vertically spaced apart and confronting the footer, and a plurality of sheet-metal studs 16 vertically positioned between the footer and the header 14. Each stud 16 has a lower end (not shown) and an upper end 18. The lower ends of each stud 16 are engaged within the footer and immediately adjacent to a top interior surface of the footer, while the upper ends 18 of each stud 16 are engaged within the header 14 and proximate to a bottom interior surface 20 of the header 14. More specifically, each of the upper ends 18 of the plurality of studs 16 are positioned apart from the bottom interior surface 20 of the header 14 a first gap distance d that allows for deflections of the ceiling 22. Thus, the first gap distance d generally ranges from about 0.5 to about 3 inches depending on the design configuration of the wall assembly.

As further shown, wallboard 24 is attached to both sides of the plurality of studs 16 (thereby defining respective wall surfaces) and each piece of wallboard 24 is positioned apart from the ceiling 22 a second gap distance d' that is about equal to the first gap distance d (in other words, also a distance ranging from about 0.5 to about 3 inches). In this exemplary embodiment and as shown, the fireblock device 10 is connected to the ceiling 22 by a plurality of fasteners 26; however, it to be understood that in other embodiments the fireblock device 10 may be connected directly to the header 14 (by way of alternating inwardly facing flange members in an alternative T-shaped configuration, for example). In either case, the interface between the header 14 and the ceiling 22 defines a head-of-wall construction joint, and the gap between the ceiling 22 and the wallboard 24 defines a wallboard construction gap 25 (having the second gap distance d'). The fireblock devices 10 is preferably positioned immediately adjacent to the wallboard 24 to thereby expose an elongated intumescent material strip 28 to the adjacent wallboard construction gap 25. The elongated intumescent material strip 28 has a width that is about equal to and preferably slightly greater than the second gap distance d'. Thus, when exposed to sufficient heat, the intumescent material strip 28 expands in a way that tends to fill the adjacent wallboard construction gap 25 and seal the adjacent head-of-wall construction joint thereby retarding the passage of smoke and fire from one room to the next.

Figure 4:
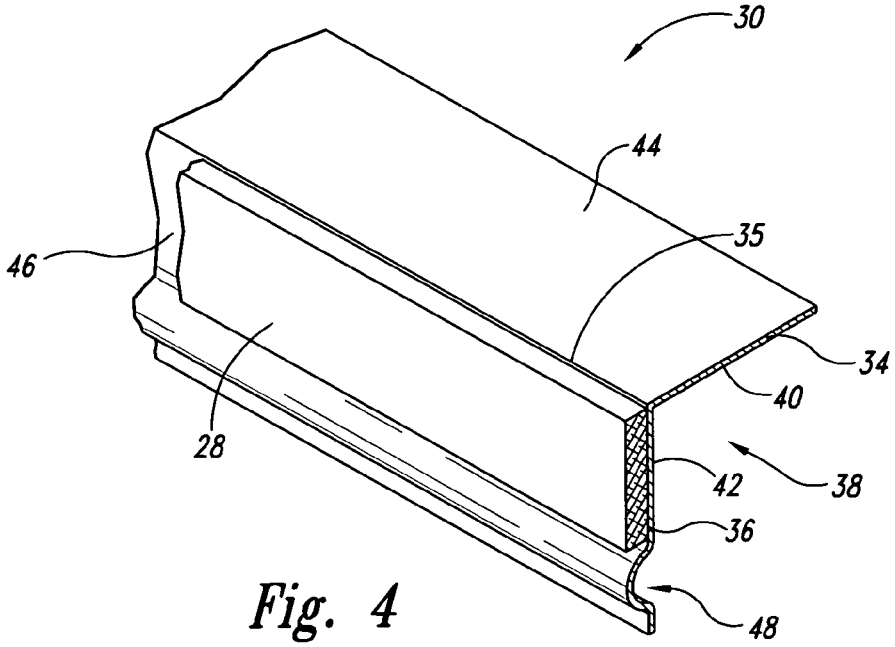
FIG. 4 illustrates a side perspective of a fireblock device in isolation and in accordance with an embodiment of the present invention.

As best illustrated in FIG. 4, the fireblock device 10 of this embodiment comprises an elongated angled channel member 30 defined by an elongated top flange member 34 integrally connected to an elongated side flange member 36 along a lengthwise edge 35. As shown, the top and side flange members 34, 36 define a right angle (i.e., a more or less 90° angle) and, relative to the top and side flange members 34, 36, a lengthwise interior corner region 38. The top and side flange members 34, 36 each have respective inner flange member surfaces 40, 42 that face inwardly with respect to the interior corner region 38, and outer flange member surfaces 44, 46 that face outwardly with respect to the interior corner region 38. The elongated channel member 30 may be made from various gauges of sheet metal (via standard cold forming techniques); it is thus generally rigid and has a thickness preferably ranging from about 0.005 to about 0.068 inches, and more preferably about 0.030 inches. The elongated channel member 30 may, however, be made in other ways such as, for example, by an extrusion process in which a viscous thermoplastic melt is forced through a shaping die in a continuous stream, cut at a suitable length, and then allowed to harden to form an elongated rigid member. Regardless of the method of manufacture, the elongated channel member 30 may be of any suitable length such as 4, 6, 8, 10, 12 or 14 foot lengths or greater, for example.

As shown, the intumescent material strip 28 is preferably positioned on the outer flange member surface 46 of the side flange member 36. More specifically, and as further shown, the intumescent material strip 28 preferably abuts an elongated protrusion 48 that runs the length of the side flange member 36 and the lengthwise edge 35. The elongated protrusion 48 extends from the outer flange member surface 46 of the side flange member 36 a distance preferably ranging from about 0.05 to about 0.75 inches, and more preferably about 0.25 inches, and corresponds to (and is defined by) an elongated groove 48 positioned along the inner flange member surface 42 of the side flange member 36. The elongated groove 48 is preferably substantially parallel with respect to the lengthwise edge 35. As shown, the height of the elongated protrusion 48 is about equal to the thickness of the intumescent material strip 28 (in other words, also about 0.05 to about 0.75 inches). In this configuration, the elongated protrusion 48 contacts the wallboard 24 and protects the intumescent material strip 28 from unwanted compression and/or wear. In an alternative embodiment, the elongated groove 48 may be replaced by a outwardly extending leg member (not shown). The intumescent material strip 28 is commercially available (e.g., 3M Company, U.S.A.) and preferably has an adhesive backing that allows the strip 28 to be readily affixed onto the outer flange member surface 46 of the side flange member 36.

Figure 6:
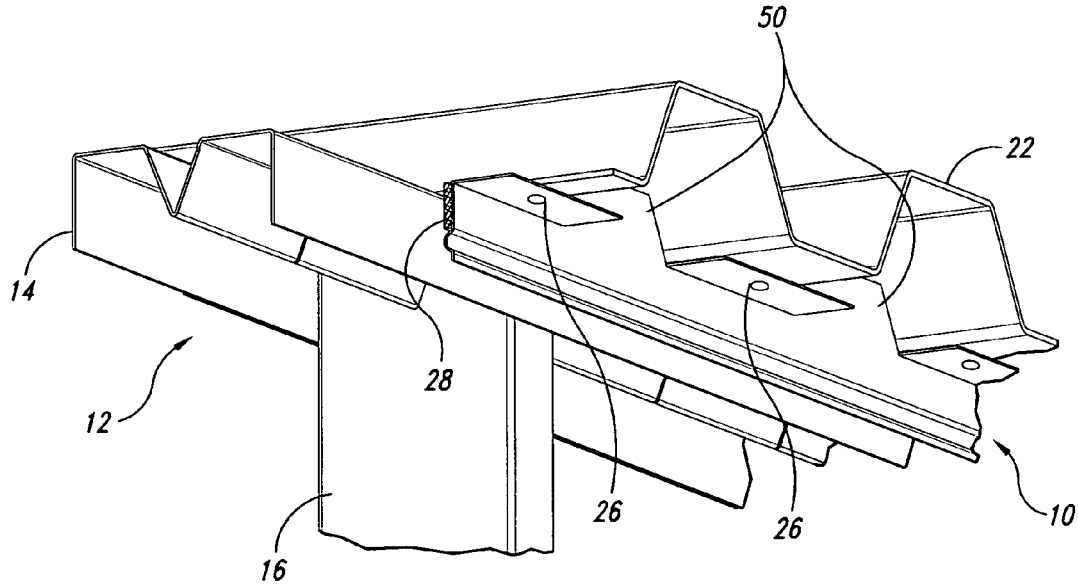
FIG. 6 illustrates a bottom side perspective view of a portion of a head-of-wall construction joint having an adjacent fireblock device in accordance with an embodiment of the present invention, wherein the device is shown in combination with a wall assembly fastened to a corrugated steel roof deck.
Figure 7:
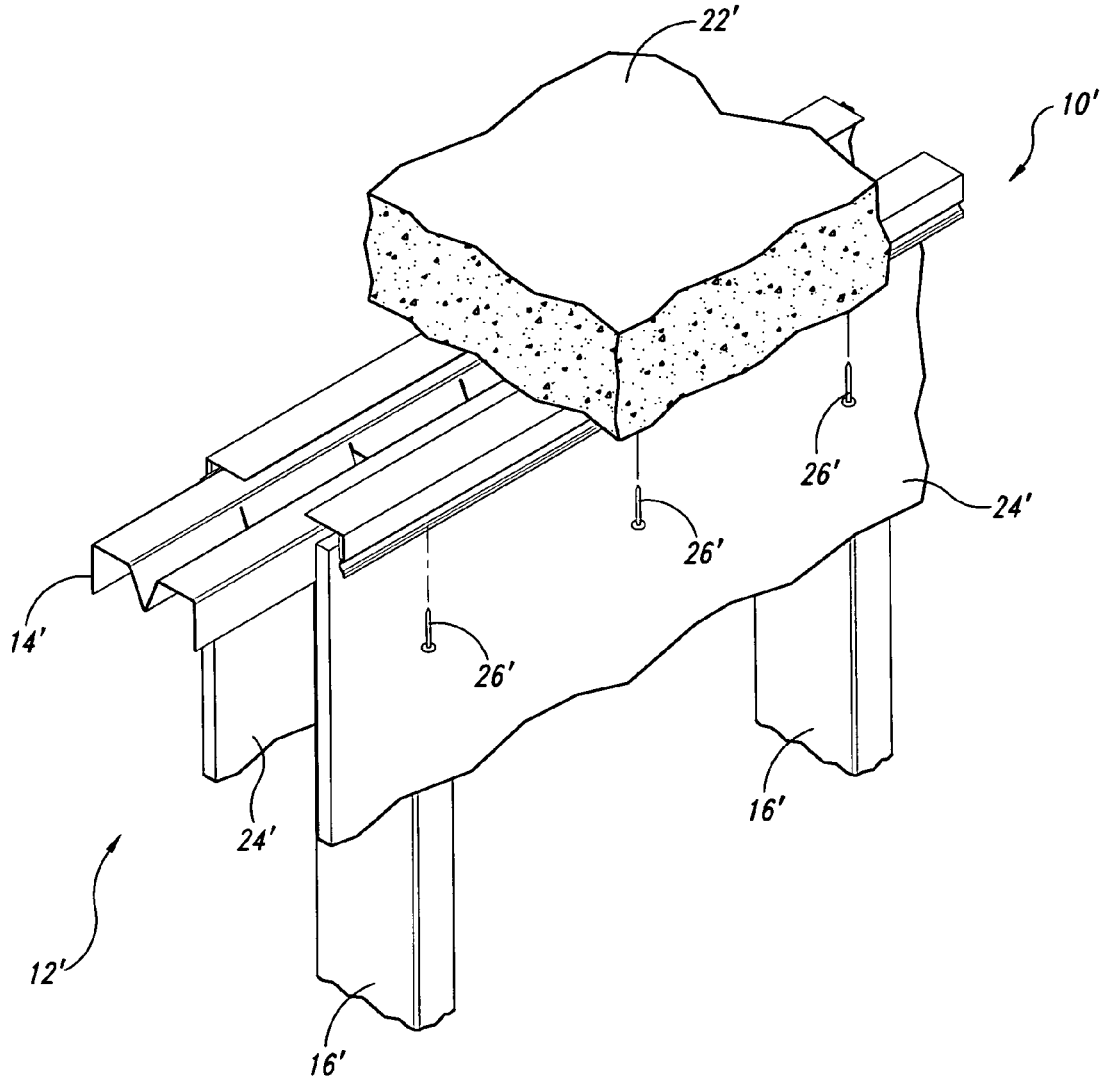
FIG. 7 illustrates a top side perspective view of a portion of a head-of-wall construction joint having an adjacent fireblock device in accordance with an alternative embodiment of the present invention, wherein the device is shown in combination with a wall assembly fastened to a concrete roof deck, and wherein the wall assembly comprises a plurality of steel studs (having wallboard affixed thereon) engaged into a M-shaped steel header channel.
Figure 8:
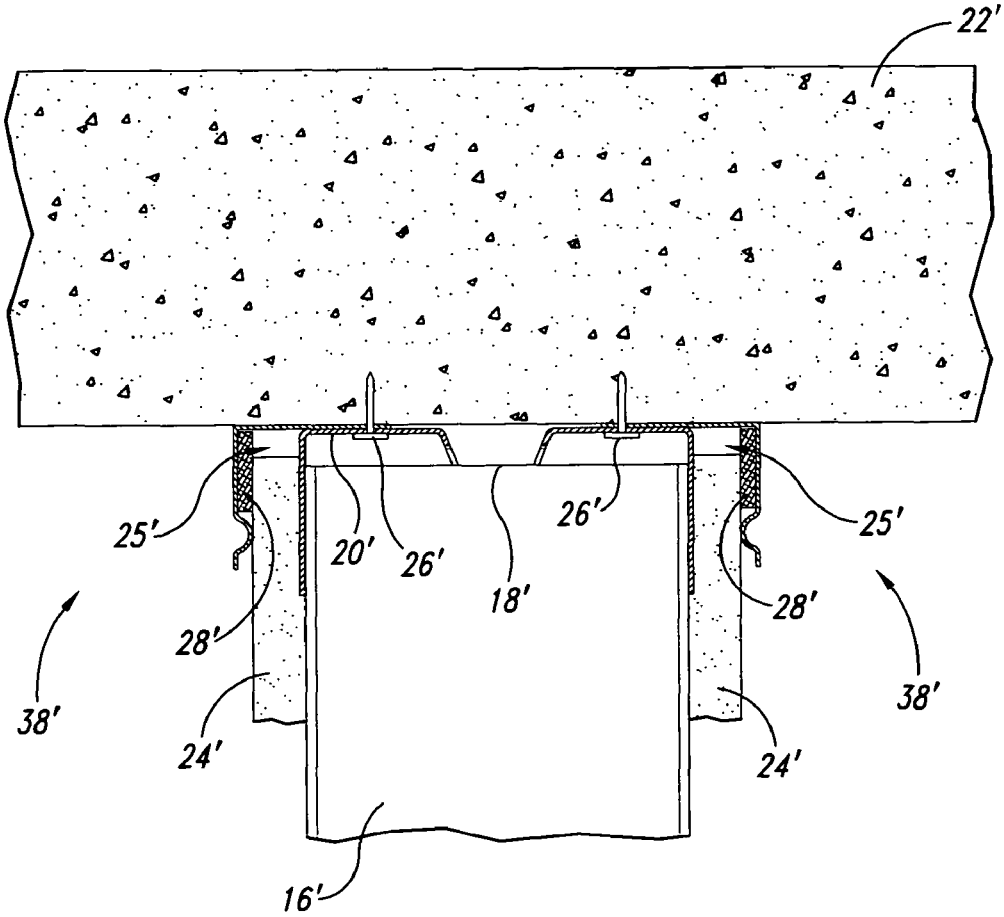
FIG. 8 illustrates a side view of the head-of-wall construction joint having an adjacent fireblock device in accordance with the embodiment of FIG. 7.
Figure 9:
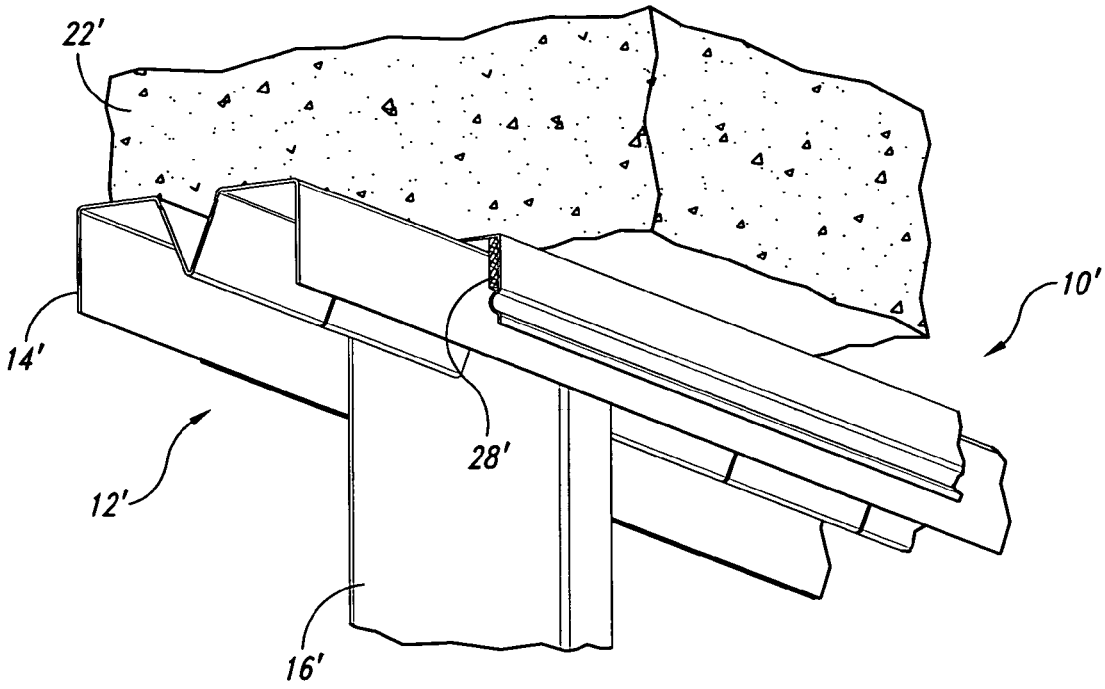
FIG. 9 illustrates a bottom side perspective view the head-of-wall construction joint having an adjacent fireblock device in accordance with the embodiment of FIG. 7 (but shown without wallboard).
Figure 10:
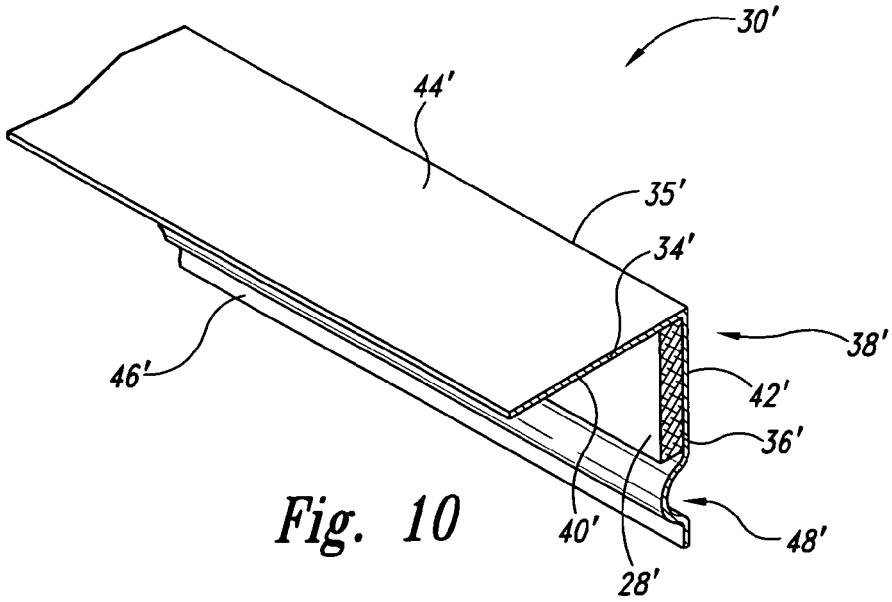
FIG. 10 illustrates a side perspective of a fireblock device in isolation and in accordance with an alternative embodiment of the present invention.

In another embodiment and as shown in FIG. 6, the fireblock device 10 may further include a plurality of flute tabs 50 connected along the lengthwise edge 35 and positioned perpendicular to the top flange member 34 (and parallel to the side flange member 36). In this configuration, each of the plurality of flute tabs 50 is generally able to substantially fill the gap between the header 14 and a corrugated or fluted roof deck (ceiling) 22 and also hold back any filler material like, for example, mineral wool that has been stuffed therebetween.

In still another embodiment and as shown in FIGS. 7-10, the fireblock device 10' comprises an elongated angled channel member 30' defined by an elongated top flange member 34' integrally connected to an elongated side flange member 36' along a lengthwise edge 35', and connected directly to the header 14 (as opposed to being fastened to the ceiling 22). As shown, the top and side flange members 34', 36' define a right angle (i.e., a more or less 90° angle) and, relative to the top and side flange members 34', 36', a lengthwise interior corner region 38'. The top and side flange members 34', 36' each have respective inner flange member surfaces 40', 42' that face inwardly with respect to the interior corner region 38', and outer flange member surfaces 44', 46' that face outwardly with respect to the interior corner region 38'. As shown, the intumescent material strip 28' is preferably positioned on the inner flange member surface 46' of the side flange member 36'. More specifically, and as further shown, the intumescent material strip 28' preferably abuts an elongated protrusion 48' that runs the length of the side flange member 36' and the lengthwise edge 35'. The elongated protrusion 48' extends from the inner flange member surface 46' of the side flange member 36' a distance preferably ranging from about 0.05 to about 0.75 inches, and more preferably about 0.25 inches, and corresponds to (and is defined by) an elongated groove 48' positioned along the outer flange member surface 42' of the side flange member 36'. The elongated groove 48' is preferably substantially parallel with respect to the lengthwise edge 35'. As shown, the height of the elongated protrusion 48' is about equal to the thickness of the intumescent material strip 28' (in other words, also about 0.05 to about 0.75 inches).

For purposes of illustration and not restriction, the following Example demonstrates the significant utility of the present invention.

EXAMPLE

Figure 2:
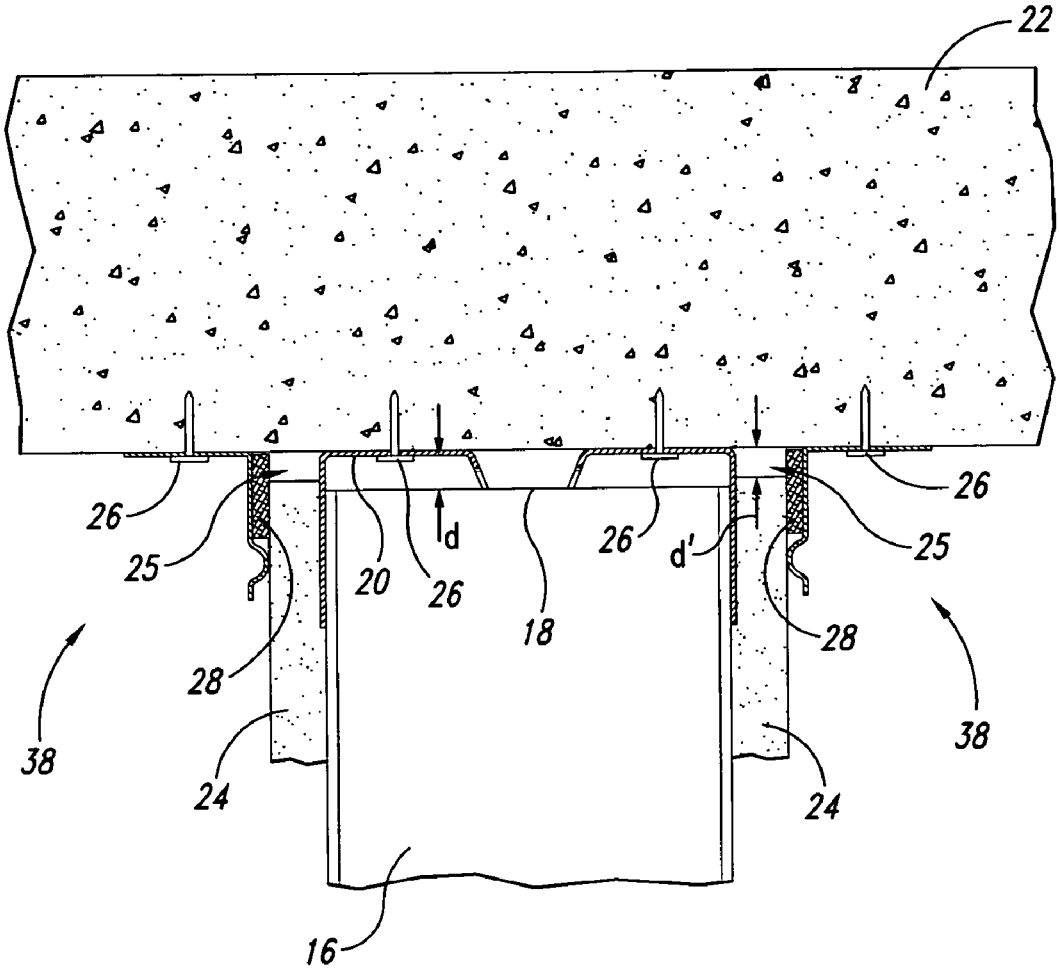
FIG. 2 illustrates a side view of the head-of-wall construction joint having an adjacent fireblock device in accordance with the embodiment of FIG. 1.
Figure 3:
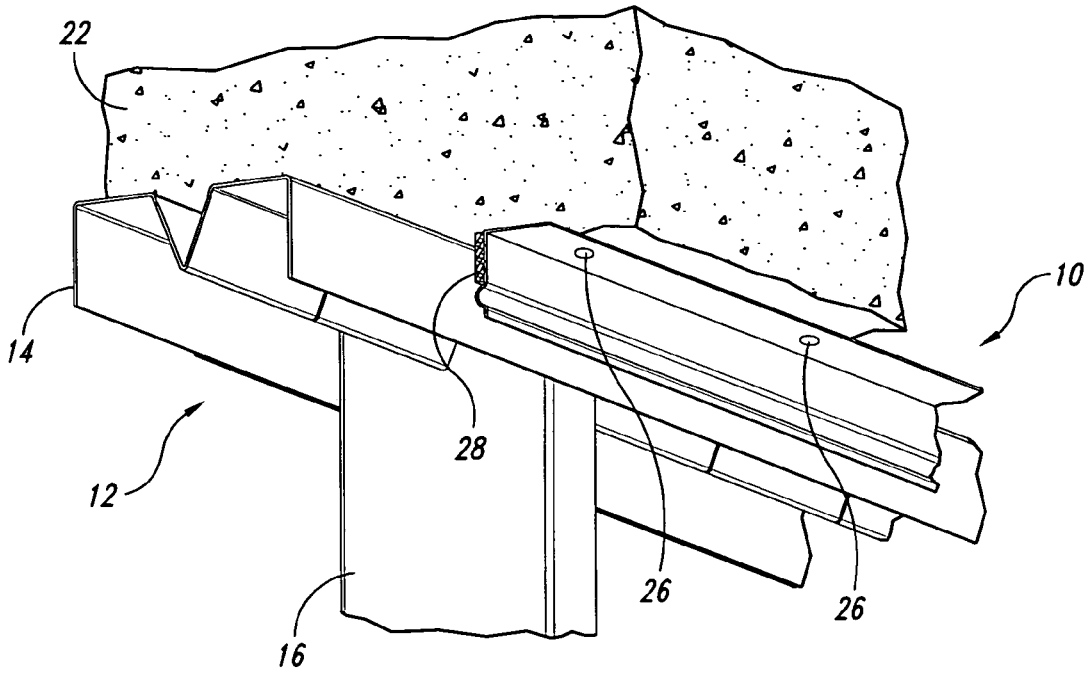
FIG. 3 illustrates a bottom side perspective view the head-of-wall construction joint having an adjacent fireblock device in accordance with the embodiment of FIG. 1 (but shown without wallboard).
Figure 5:
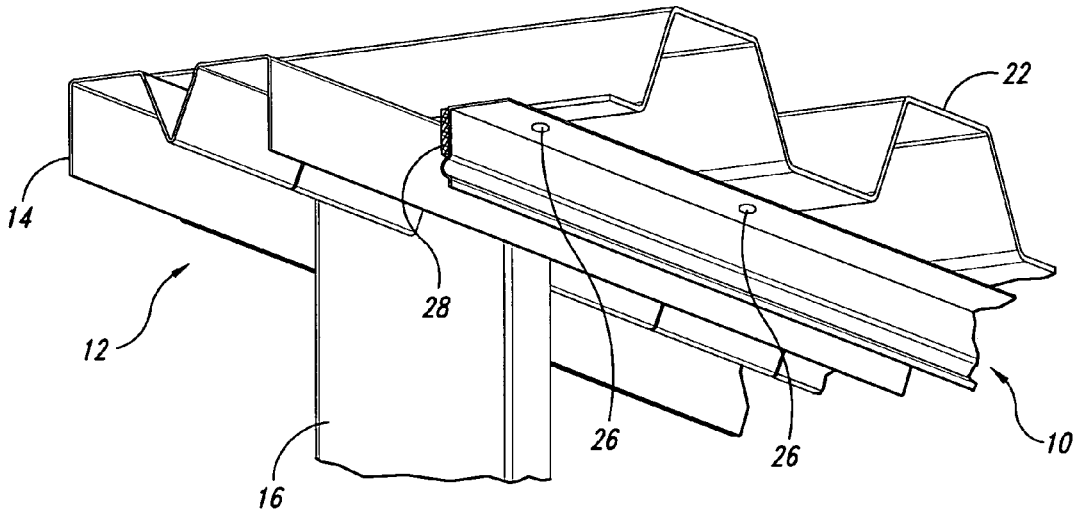
FIG. 5 illustrates a bottom side perspective view of a portion of a head-of-wall construction joint having an adjacent fireblock device in accordance with an embodiment of the present invention, wherein the device is shown in combination with a wall assembly fastened to a corrugated steel roof deck.

From Jul. 20 to Jul. 26, 2005, a series of head-of-wall joint firestop system tests were conducted to evaluate the effectiveness of the fireblock device generally shown in FIGS. 1-5 in combination with a dynamic head-of-wall assembly also generally shown in FIGS. 1-3, and 5. The test were conducted in accordance with UL 2079, "Tests for Fire Resistance of Building Joint Systems" (also known as the 2-hour fire and hose stream test). In the tests, the joint length was approximately 1 meter and the joint movement or deflection was approximately 1 inch. The dynamic head-of-wall assembly was cycled or deflected 500 times at about 10 cycles per minute and was then fire tested at maximum extension. The fireblock device in combination with a dynamic head-of-wall assembly readily passed the 2-hour fire and hose stream test, both when the ceiling was a concrete slab as shown in FIGS. 1-3 and when the ceiling was a fluted roof deck as shown in FIG. 5.

While the present invention has been described in the context of the embodiments illustrated and described herein, the invention may be embodied in other specific ways or in other specific forms without departing from its spirit or essential characteristics. Therefore, the described embodiments are to be considered in all respects as illustrative and not restrictive. The scope of the invention is, therefore, indicated by the appended claims rather than by the foregoing descriptions, and all changes that come within the meaning and range of equivalency of the claims are to be embraced within their scope.

What is claimed is:

1. A head-of-wall fireblock device in combination with a head-of-wall assembly, comprising:

an elongated sheet-metal header track having a top track surface attached to a ceiling;

a plurality of sheet-metal studs having upper and lower ends, the studs being vertically positioned relative to the ceiling and such that the upper ends are engaged within the header track;

an elongated right angled channel member attached to the ceiling, the header track, or the ceiling and the header track, the right angled channel member being defined by an elongated top flange member connected to an elongated side flange member along a lengthwise linear edge, the top flange member and the side flange member together form a right angle, the top flange member having an upper top flange member surface that is substantially coplanar with the top track surface;

an intumescent material affixed lengthwise on the side flange member; and an elongated lengthwise protrusion integrally positioned along the side flange member on the same side as the intumescent material, wherein the elongated lengthwise protrusion runs along the length direction of the header track, and wherein the elongated lengthwise protrusion, the elongated top flange member, and the elongated side flange member are made from a single piece of sheet metal.

2. The head-of-wall fireblock device in combination with a head-of-wall assembly according to claim 1 wherein the elongated protrusion and the lengthwise linear edge are substantially parallel to each other.

3. The head-of-wall fireblock device in combination with a head-of-wall assembly according to claim 2, further comprising a wallboard interposed between the intumescent material and the plurality of sheet-metal studs.

* * * * *